US006626700B2

(12) United States Patent
Lin

(10) Patent No.: US 6,626,700 B2
(45) Date of Patent: Sep. 30, 2003

(54) STACKED CONNECTOR WITH GROUNDING CONDUCTORS

(76) Inventor: Chien-Chung Lin, No. 3-2, Lane 32, Kuo Feng Chi St., Taoyuan City, Taoyuan Hsien (TW)

( * ) Notice: Subject to any disclaimer, the term of this patent is extended or adjusted under 35 U.S.C. 154(b) by 0 days.

(21) Appl. No.: 09/897,609

(22) Filed: Jul. 3, 2001

(65) Prior Publication Data

US 2003/0008552 A1 Jan. 9, 2003

(51) Int. Cl.[7] ..... H01R 13/66
(52) U.S. Cl. ..... 439/541.5; 439/607
(58) Field of Search ..... 439/92, 79, 108, 439/181, 541.5, 607

(56) References Cited

U.S. PATENT DOCUMENTS 6,200,161 B1 * 3/2001 McClinton et al. ..... 439/541.5
6,296,518 B1 * 10/2001 Avery et al. ..... 439/541.5
6,302,731 B1 * 10/2001 Kring ..... 439/541.5

* cited by examiner

*Primary Examiner*—Khiem Nguyen
(74) *Attorney, Agent, or Firm*—Rosenberg, Klein & Lee

(57) ABSTRACT

A connector includes a first plug, a second plug and a connecting casing. One side of each of the first plug and second plug can be inserted with a computer peripheral device (such as a mouse, or a modem). The first plug and second plug are firmly secured to the connecting casing. The connecting casing is integrally made of plastic injection. A plurality of metal plates are installed on the connecting casing, in that two of the metal plates being connected to the connecting surface of the connecting casing. The metal plate on the connecting casing has conduction effect so that the electrostatic charges on a circuit board can be lead out effectively to provide steady message to the computer peripheral devices. Therefore, the cost is down and can be mass-produced.

1 Claim, 5 Drawing Sheets

STACKED CONNECTOR WITH GROUNDING CONDUCTORS

FIELD OF THE INVENTION

The present invention relates to a connector, and especially to a connector which is connected to the computer peripheral devices or other related products.

BACKGROUND OF THE INVENTION

Referring to FIG. 1, a prior art connector is illustrated. The connector includes a plug 10. The plug 10 can be inserted into a computer peripheral device (such as modem, mouse, etc.) (not shown). A plurality of connecting terminals 101 are formed in the plug 10. The connecting terminals 101 can be connected to a circuit board or the related circuit board (not shown). The plug 10 is screwedly connected to a metal plate 12 by using screws 11. One end of the plug 10 is connected to a protecting cover 13. The cover 13 may avoid the deformation of the connecting terminal 101. The cover 13 can support the plug 10.

Since the connecting terminal 101 can be inserted into a circuit board of a computer or other related circuit board. The circuit board can be inserted to a power source. In order that the computer peripheral device is not affected by electrostatic charges and to provide a steady message, the metal plate 12 of above structure is made of zinc alloy with a preferred hardness so as to generate a conduction effect. The electrostatic charges are lead out by the metal plate 12 so as to have a ground effect.

However, since the metal plate 12 of the zinc alloy has a preferred hardness and thus it is hard to be shaped and thus the assembly work is hard. Furthermore, the assembly cost is high. Furthermore, since the zinc alloy is expensive and thus the assembly cost is high.

SUMMARY OF THE INVENTION

Accordingly, the primary object of the present invention is to provide a connector which is connected to the computer peripheral devices or other related products. The outer cover plate is made of plastic injection so as to reduce cost. A conduction effect is formed by the first metal plate and second metal plates so that the electrostatic charges in the circuit board can be lead out effectively for replacing the prior art zinc alloy product which has a preferred hardness and can be shaped, and is more expensive than the plastic frame. Since the cost of zinc is high so as to increase the whole cost of a computer in assembly.

To achieve the objects, the present invention provides a connector including a first plug, a second plug and a connecting casing. The first plug and second plug are installed with a plurality of terminals. each side of the first plug and second plug can be inserted with a computer peripheral device (such as a mouse, or a modem). The first plug and second plug are firmly secured to the connecting casing. The connecting casing is integrally made of plastic injection. A plurality of metal plates are installed on the connecting casing. The metal plate on the connecting casing has effect of conduction so that the electrostatic charges on a circuit board can be lead out effectively to provide steady message to the computer peripheral devices. Therefore, the cost is reduced and can be mass-produced. The plurality of metal plates are formed with two holding portions for buckling a circuit board.

The various objects and advantages of the present invention will be more readily understood from the following detailed description when read in conjunction with the appended drawing.

DETAILED DESCRIPTION OF THE PREFERRED EMBODIMENTS

To more understand the present invention by those skilled in the art, in the following, the details will be described with the appended drawings. However, all these descriptions are used to make one fully understand the present invention, while not to used to confine the scope of the present invention defined in the appended claims.

Referring to FIGS. 2, 3, 4, and 5, the connector of the present invention is provided which is especially used to connect a circuit board of a computer or other related circuit board. The connector is formed by a first plug 20, a second plug 30 and a connecting casing 40.

Figure 5:
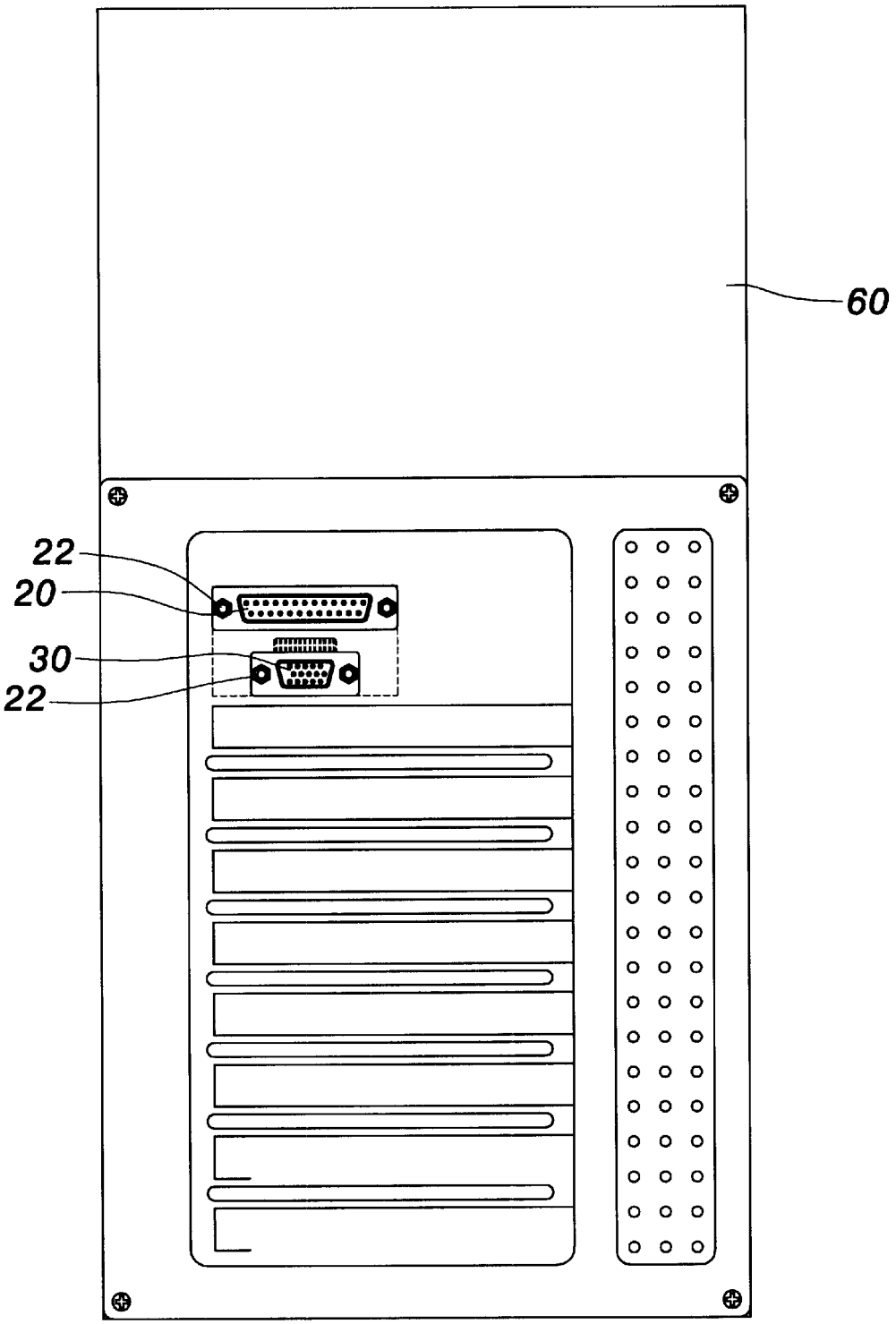
FIG. 5 is a schematic view showing the use of the present invention.

The first plug 20 is firmly secured to the second plug 30. One sides of the first plug 20 and second plug 30 are inserted into the peripheral devices (such as a mouse, a modem, etc. (not shown)) of a computer 50 (FIG. 5). The first plug 20 and second plug 30 are installed with a plurality of terminals 21 and 31. The terminals 21 and 31 are insertable to a circuit board (not shown) of a computer. The first plug 20 and second plug 30 can be screwedly connected to the connecting casing 40 by screws 22. The aforesaid structure is identical to the prior art structure, and thus the details will not be described in the following.

Referring to FIGS. 2, 3, 4 and 5. In the present invention, the connecting casing 40 is made by plastic injection and is integrally formed. The connecting casing 40 has an approximately "L" shape. The connecting casing 40 is installed with a plurality of screw holes 41 which can be inserted by screws 22 so as to be connected to the first plug 20 and the second plug 30.

The connecting casing 40 is formed with a connecting plate 42 and a bottom member 43. The two lateral sides of the connecting plate 42 are connected with two first metal plates 421 near the edge thereof. Each first metal plate 421 is formed with a plurality of through holes 422 with respect to the screw holes 41. The through hole 422 can be screwedly connected with a plurality of screws 22 by a retainer 50. The though holes 422 serve to enhance the connecting force between the first plug 20 and the connecting casing 40. The connecting plate 42 has a receiving space 424 formed above a frame 423 to receive the first plug 20. A vertical plate 431' protrudes rearwardly from the connecting plate 42 on each side of the receiving space 424, to capture the first plug 20 therebetween and enhance the strength of connecting plate 42.

The inner portion of the connecting casing 40 is installed with a frame 423. The frame 423 serves to receive the second plug 30. The two lateral sides of the frame 423 are installed with two respective plates 431. The two plates 431 capture the second plug 30 between the two plates 431

Figure 1:
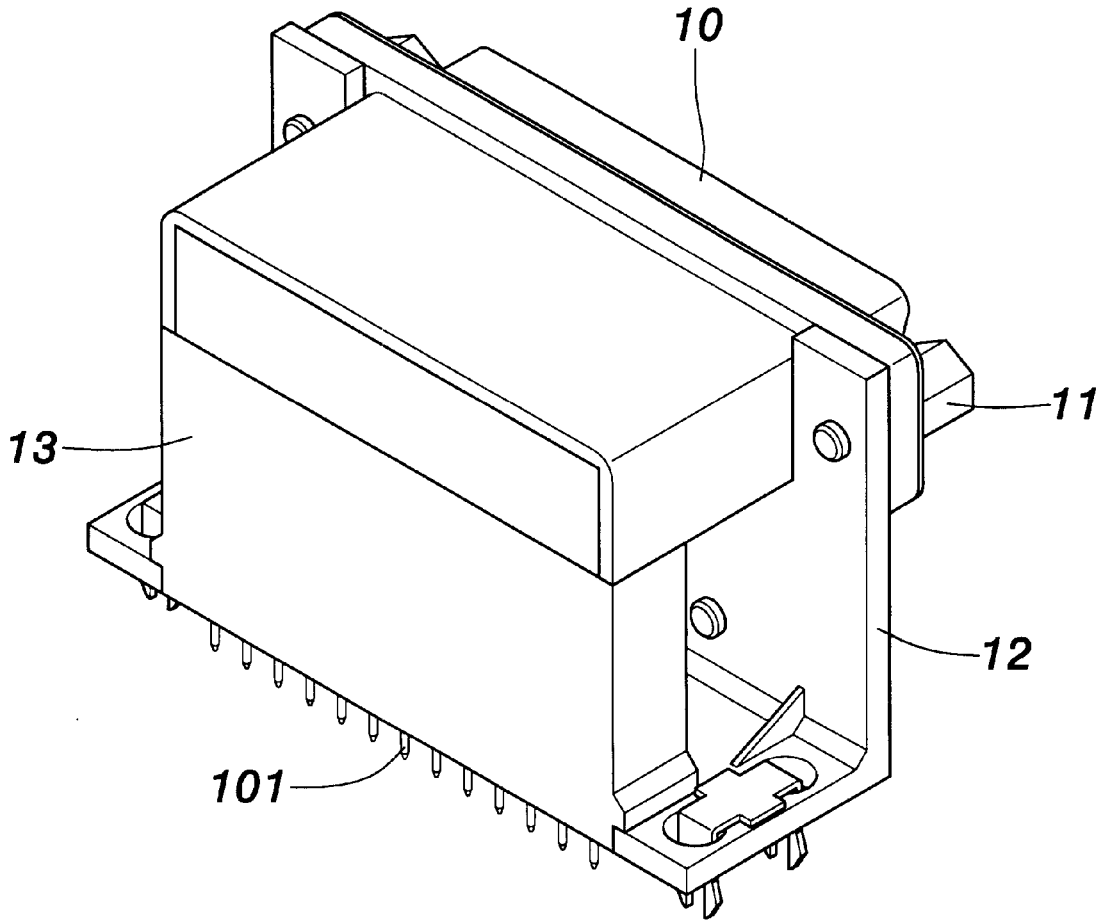
FIG. 1 PRIOR ART
FIG. 1 is a perspective view of a prior art connector structure.
Figure 2:
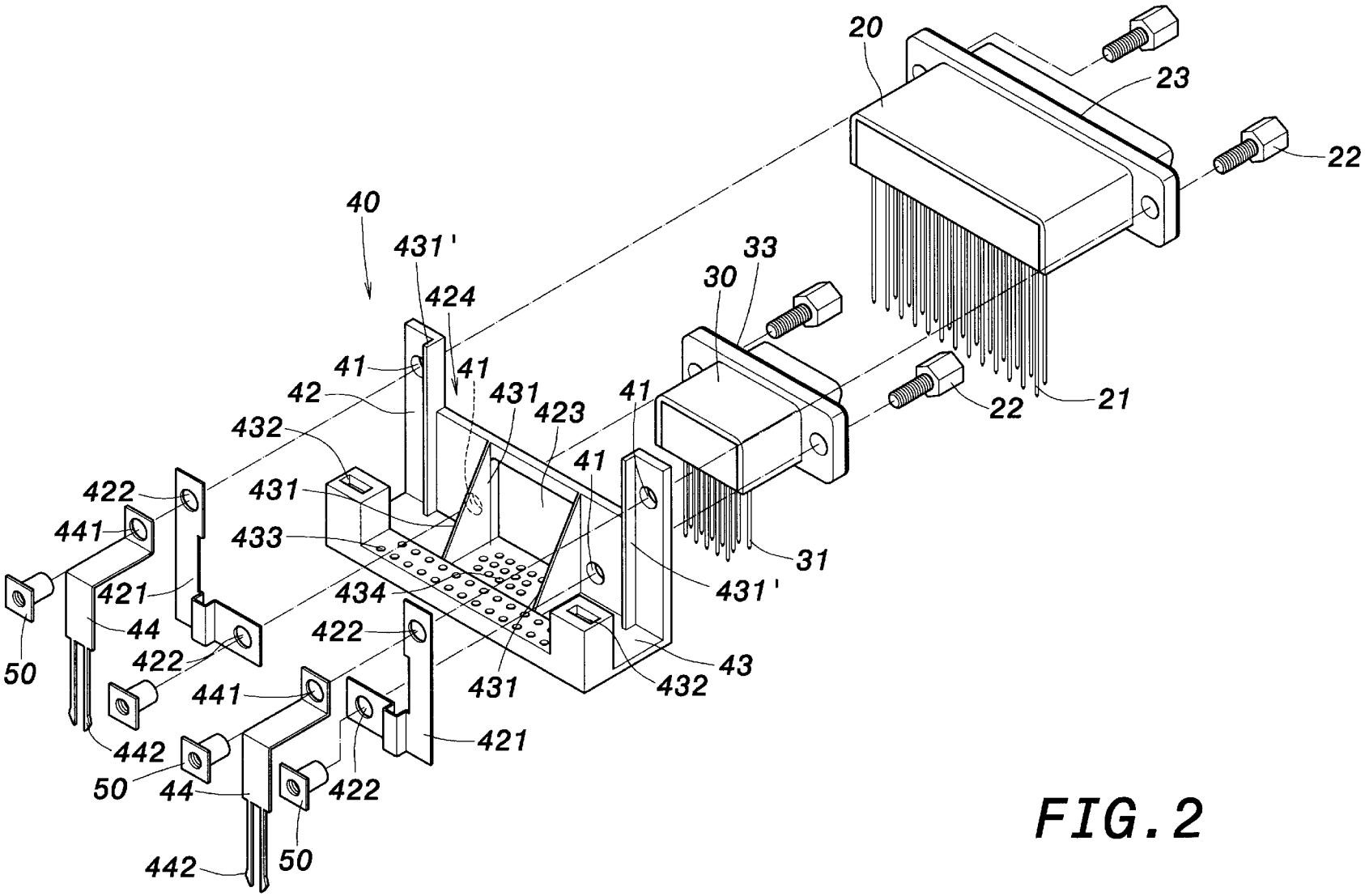
FIG. 2 is an exploded perspective view of the present invention.
Figure 3:
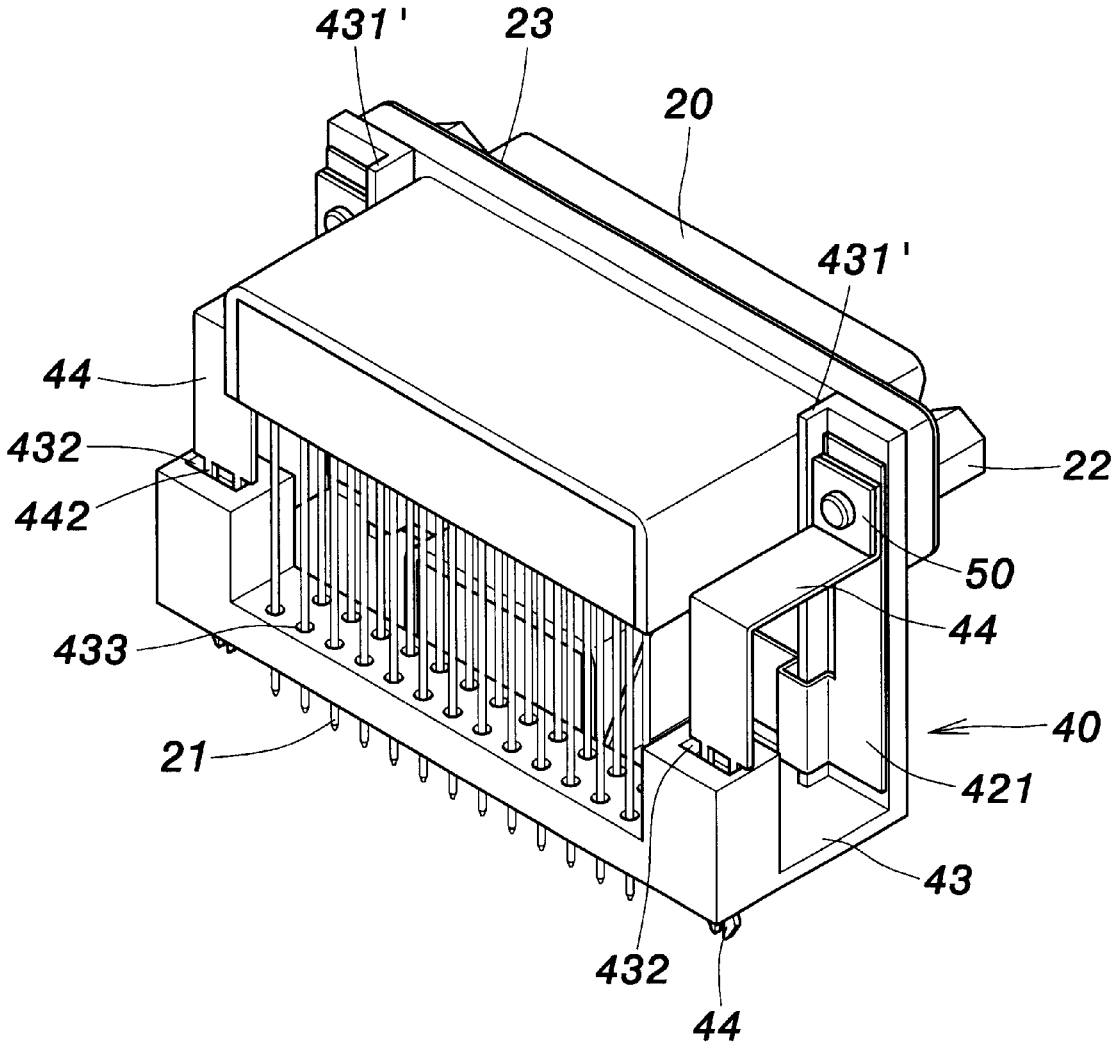
FIG. 3 is an assembled perspective view of the present invention.
Figure 4:
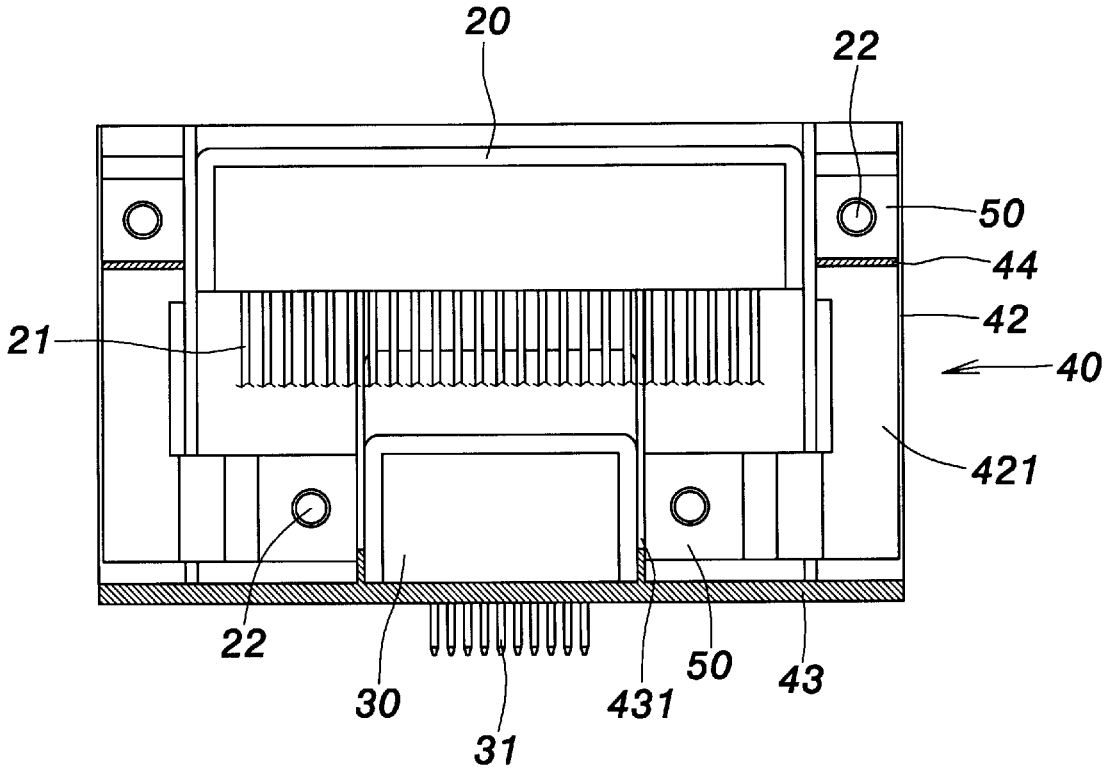
FIG. 4 is a cross sectional view of the present invention.

(referring to FIG. 4). The two plates 431 serve to enhance the integral strength of the connecting casing 40.

The bottom member 43 of the connecting casing 40 has a side with two inserting slots 432 and a plurality of apertures 433 and 434 for respectively receiving the plurality of terminals 21 and 31. The slots 432 are utilized to receive the two second metal plates 44. The second metal plate 44 has the effect of electric conduction. The two second metal plates 44 are formed with openings 441. Thereby, the retainer 50 can be screwed to the connecting surface 42 using a plurality of screws 22. One end of each second metal plate 44 is installed with two holding portions 442. The two holding portions 442 are used to buckle the circuit board of a computer 60 or other related circuit board.

In the present invention, the connecting plate 42 is screwedly connected to two ends of two first metal plates 421 through openings 422 and two second metal plates 44 through the openings 441. The first plug 20 and second plug 30 are screwedly connected to the connecting plate 42 through the screws 22 and the retainer 50. A conduction effect is formed by the first metal plates 421 and second metal plates 44 so that the electrostatic charges in the circuit board can be lead out effectively, for replacing the prior art zinc alloy product which has a preferred hardness, and is capable of shaping, but difficult in assembly. The frame of zinc alloy is more expensive than the plastic frame.

By the present invention, the electrostatic charges must be lead out effectively so that computer peripheral devices will not be affected by electrostatic charges to provide a steady message. Not only the cost is reduced, but also the burden of the user is decreased. Furthermore, the present invention can be mass-produced and can be produced conveniently.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A stacked connector with grounding conductors, comprising:

a first plug having a predetermined first width and a plurality of first terminals;

a second plug having a predetermined second width and a plurality of second terminals, said predetermined second width being different than said predetermined first width;

a connecting casing adapted for securing said first and second plugs thereto in stacked relationship by respective first and second pairs of screws, said connecting casing formed of injection molded plastic and having an L-shaped contour defined by a connecting plate at a front end of said connecting casing and a bottom member extending rearwardly from a lower end of said connecting plate, said connecting plate having a receiving space for receiving said first plug disposed above a frame for receiving said second plug, said connecting plate having a vertical plate disposed on opposing sides of said receiving space and protruding rearwardly therefrom for capturing said first plug therebetween and strengthening said connecting plate, said connecting casing having a pair of triangularly shaped plates respectively disposed on opposing sides of said frame, each of said triangle plates being coupled to both said bottom member and said connecting plate for capturing said second plug therebetween and strengthening said connecting casing, said bottom member having (a) a plurality of first apertures formed therein for respectively supporting passage of said first terminals therethrough, (b) a plurality of second apertures formed therein for respectively supporting passage of said second terminals therethrough, and (c) a pair of slots respectively formed in opposing ends of said bottom member;

a pair of first grounding metal plates respectively disposed adjacent opposing ends of said conducting plate, each of said first grounding metal plates having a respective opening formed through opposing end portions thereof, said opposing end portions of each said first grounding metal plate being respectively disposed adjacent a corresponding side of said first and second plugs, a respective one of each said first and second pairs of screws respectively passing through said openings of each said first grounding metal plate;

a pair of second grounding metal plates respectively electrically coupled to said pair of first grounding metal plates, each of said second grounding metal plates having a first end with an opening formed therethrough and a second opposing end being bifurcated to form a holding portion, said first end of each of said second grounding metal plates overlaying one end portion of a corresponding one of said first grounding metal plates with said opening of said second grounding metal plate being aligned with a corresponding one of said openings of said corresponding first grounding metal plate for passage of a respective one of said screws therethrough, said second end of each of said second grounding metal plates being passed through a respective one of said slots of said bottom member for electrical connection to a circuit board; and, a plurality of retainers respectively threadedly engaged with said first and second pairs of screws.

* * * * *